US008734268B2

(12) United States Patent
Sato

(10) Patent No.: US 8,734,268 B2
(45) Date of Patent: May 27, 2014

(54) GOLF CLUB SHAFT AND GOLF CLUB THEREWITH

(75) Inventor: Fumiaki Sato, Chichibu (JP)

(73) Assignee: Bridgestone Sports Co., Ltd, Tokyo (JP)

( * ) Notice: Subject to any disclaimer, the term of this patent is extended or adjusted under 35 U.S.C. 154(b) by 285 days.

(21) Appl. No.: 13/240,517

(22) Filed: Sep. 22, 2011

(65) Prior Publication Data

US 2012/0083357 A1 Apr. 5, 2012

(30) Foreign Application Priority Data

Oct. 4, 2010 (JP) ..... 2010-224690

(51) Int. Cl.
*A63B 53/10* (2006.01)

(52) U.S. Cl.
USPC ..... 473/319

(58) Field of Classification Search
USPC ..... 473/316–323
See application file for complete search history.

(56) References Cited

U.S. PATENT DOCUMENTS

| | | | | | |
|---|---|---|---|---|---|
| 5,439,219 | A * | 8/1995 | Vincent | 473/319 |
| 5,935,017 | A * | 8/1999 | Weaver et al. | 473/319 |
| 6,056,648 | A * | 5/2000 | Kusumoto et al. | 473/319 |
| 6,117,021 | A * | 9/2000 | Crow et al. | 473/289 |
| 6,139,444 | A * | 10/2000 | Renard et al. | 473/320 |
| 6,322,458 | B1 * | 11/2001 | Kusumoto et al. | 473/316 |
| 6,875,127 | B2 * | 4/2005 | Hasegawa | 473/319 |
| 6,915,695 | B2 * | 7/2005 | Weiss et al. | 73/579 |
| 7,070,512 | B2 * | 7/2006 | Nishio | 473/319 |
| 7,318,780 | B2 * | 1/2008 | Oyama | 473/319 |
| 7,427,240 | B2 * | 9/2008 | Takeuchi | 473/319 |
| 7,524,248 | B2 * | 4/2009 | Kumamoto | 473/319 |
| 7,736,245 | B2 * | 6/2010 | Hasegawa | 473/319 |
| 8,021,244 | B2 * | 9/2011 | Kato | 473/319 |
| 8,414,417 | B2 * | 4/2013 | Sato | 473/316 |
| 2006/0073905 | A1 * | 4/2006 | Oyama | 473/316 |
| 2008/0004127 | A1 * | 1/2008 | Takeuchi | 473/292 |
| 2008/0070716 | A1 * | 3/2008 | Kumamoto | 473/289 |

FOREIGN PATENT DOCUMENTS

| | | | | |
|---|---|---|---|---|
| JP | 08-234256 | A | 9/1996 | |
| JP | 11099229 | A * | 4/1999 | A63B 53/10 |
| JP | 2002-177423 | A | 6/2002 | |
| JP | 2004290391 | A * | 10/2004 | A63B 53/10 |
| JP | 2008-073067 | A | 4/2008 | |
| JP | 2008-148757 | A | 7/2008 | |
| JP | 2008-212340 | A | 9/2008 | |
| JP | 2010022749 | A * | 2/2010 | |

OTHER PUBLICATIONS

Japanese Office Action issued in Japanese Application No. 2010-224690 dated Mar. 4, 2014.

* cited by examiner

*Primary Examiner* — Stephen L. Blau
(74) *Attorney, Agent, or Firm* — Sughrue Mion, PLLC

(57) ABSTRACT

A golf club shaft has a length of a shaft of 1050 mm to 1170 mm and a sum of flexural rigidities at positions 150 mm, 200 mm and 250 mm from a front end of the shaft of A1, a sum of flexural rigidities at positions 400 mm, 450 mm and 500 mm from the front end of the shaft of A2 and a sum of flexural rigidities at positions 650 mm, 700 mm and 750 mm from the front end of the shaft of A3, distribution of flexural rigidities is 1.70≤A3/A2 and 0.60≤A1/A3.

4 Claims, 4 Drawing Sheets

GOLF CLUB SHAFT AND GOLF CLUB THEREWITH

CROSS-REFERENCE TO RELATED APPLICATION

This application claims priority on Japanese Patent Application No. 2010-224690 filed Oct. 4, 2010, which is incorporated herein by reference in its entirety.

BACKGROUND OF THE INVENTION

The present invention relates to a golf club shaft and a golf club having the same.

Distributions of flexural rigidity over an entire length from a front end of a golf club shaft up to a grip end have been considered in designing of a golf club in order to increase flight distance of a golf ball. For example, JP H9-234256 A describes designing of such a distribution of the flexural rigidity that it reaches its highest point at a central portion of the shaft between a position 300 mm from a front end of the shaft and a position 300 mm off the grip end of the shaft. Such a distribution of the flexural rigidity maintains the axis of a shaft substantially linearly during a swing and consequently, it is easy to bring back the face surface of a golf club to a position when addressing the ball accurately, thereby an increase of the ball flight distance and improvement of its directionality being achieved.

JP 2002-177423 A describes designing of a change ratio of the flexural rigidity of an area H 100 to 450 mm long in a region 0 to 450 mm from a shaft grip end to 1 to 5 times the change ratio of the flexural rigidity in an area M 200 to 500 mm long in a region 400 to 900 mm from the shaft grip end. According to the same patent document, in the area M, the flexural rigidity is increased gradually from the front end toward the grip end, so that a sufficient flexure and restoration of a deformed shaft induce an increase of the flight distance. In the area H, the change ratio of the flexural rigidity is adjusted to be larger than the area M, and consequently, the flexural rigidity is increased, thereby a firm grip feeling and stability of a flying ball direction being secured.

Additionally, JP 2008-212340 A describes designing so that a difference in flexural rigidity values between a position 150 mm from a front end and a position 950 mm from the front end is 5 $kg \cdot m^2$ or more in a shaft length of 1100 mm or more and the flexural rigidity of a position 150 mm from the front end is 2 $kg \cdot m^2$ or less. This design is made for ordinary amateur golfers whose head speed is relatively slow and is intended to fly a ball high easily to increase the flight distance of a ball.

SUMMARY OF THE INVENTION

Most intermediate-grade golfers having a handicap of around 20 who are ordinarily called average golfers potentially embrace problems that the flight distance of the golf ball will not be improved as expected or that their swings are not stabilized. In most cases, these problems result from using no golf clubs suitable for their own abilities or play styles and specifically, golf club characteristics such as the flexural rigidity of the golf club shaft are considered to be an important cause. With such a problem as a background, demands for golf club shafts appropriate for average golfers have intensified in recent years.

In view of the above-described problems, the present invention intends to provide a golf club having a distribution of rigidities which adequately provides flexure of the shaft for average golfers and suppresses a fluctuation of swing, thereby, improving the head speed, increasing the flight distance of a golf ball and securing the stability of swing.

To achieve the above-described object, there is provided a golf club shaft wherein assuming that the length of a shaft is 1050 mm to 1170 mm and a sum of flexural rigidities at positions 150 mm, 200 mm and 250 mm from a front end of the shaft is A1, a sum of flexural rigidities at positions 400 mm, 450 mm and 500 mm from the front end of the shaft is A2 and a sum of flexural rigidities at positions 650 mm, 700 mm and 750 mm from the front end of the shaft is A3, distribution of flexural rigidities is $1.70 \leq A3/A2$ and $0.60 \leq A1/A3$.

Preferably, the mass of the shaft is not more than 45 g and flexing thereof is not more than 4.3 kg in terms of a load value based on three-point support measuring method. The distribution of flexural rigidities is preferred to be $1.70 \leq A3/A2 \leq 2.00$ and $0.60 \leq A1/A3 \leq 0.70$. Preferably, as regards the flexural rigidity of a section 150 mm to 900 mm from the front end of the shaft, a minimum value of the flexural rigidity is not more than $1.5 \times 10^6$ $kgf/mm^2$ and a difference between the maximum value and minimum value of the flexural rigidity is not less than $3.5 \times 10^6$ $kgf/mm^2$.

A feature of the golf club of the present invention exists in having the above described golf club shaft.

In a golf club shaft 1050 mm to 1170 mm long, when assuming that a sum of flexural rigidities at positions 150 mm, 200 mm and 250 mm from the front end of the shaft is A1, a sum of flexural rigidities at positions 400 mm, 450 mm and 500 mm from the front end of the shaft is A2 and a sum of flexural rigidities at positions 650 mm, 700 mm and 750 mm from the front end of the shaft is A3, distribution of flexural rigidities is set to $1.70 \leq A3/A2$ and $0.60 \leq A1/A3$. Under such a predetermined relationship, a central portion of the shaft is formed to be soft while the front end portion and the grip portion are formed to be hard. Consequently, the grip portion of the shaft to which a force is applied when a golfer uncocks his or her wrist is hard so as to ensure a firm grip, and furthermore, the front end portion of the shaft is hard so as to minimize the fluctuation of the front end upon impact. In addition, by forming the central portion of the shaft to be soft under the above-described relationship, the shaft can be bowed sufficiently. As a result of these effects, swing motions of average golfers are stabilized and the head speed of the golf club increases, so that the flight distance of the golf ball is increased.

DETAILED DESCRIPTION OF THE PREFERRED EMBODIMENTS

Hereinafter, embodiments of a golf club shaft and a golf club having the same according to the present invention will be described in detail with reference to the accompanying drawings. It should be noted, however, that the present invention is not limited to the following examples.

Figure 1:
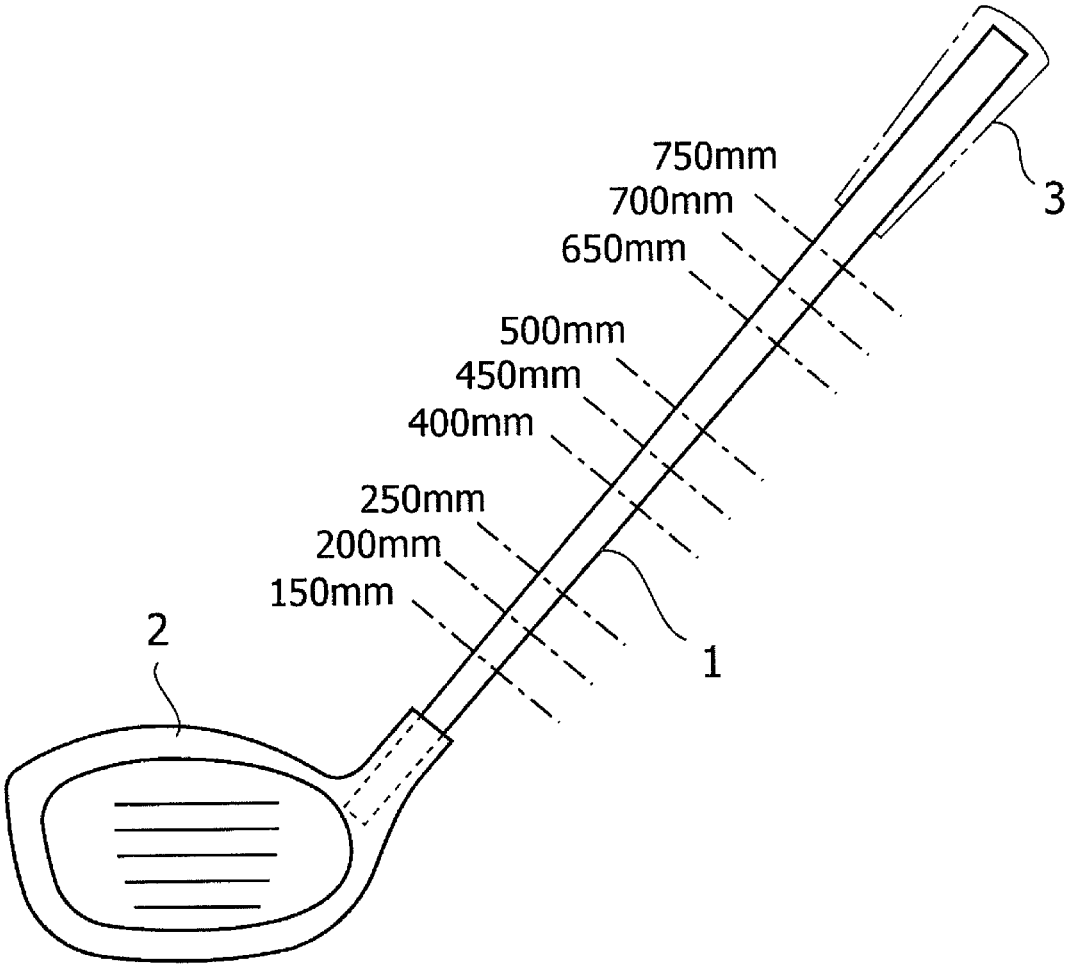
FIG. 1 is a front view of a golf club.

FIG. 1 shows a golf club, usually called a driver. A front end of a shaft 1 of the driver is inserted and fixed in a head 2 and a grip 3 is attached to the proximal end of the shaft 1. Preferably, the lower limit of the length of the shaft 1 is about 1050 mm, more preferably about 1100 mm. Preferably, the upper limit of the length of the shaft 10 is about 1170 mm, more preferably 1150 mm. The reason the length of the shaft is set relatively long is that the shaft of the present invention is intended for woods, specifically for drivers because one of the purposes of the present invention is to increase the flight distance of a golf ball. Another reason is that drivers are available for men and women individually and different in length of the shaft between them.

FIG. 1 indicates positions 150 mm, 200 mm, 250 mm, 400 mm, 450 mm, 500 mm, 650 mm, 700 mm and 750 mm off the front end of the shaft 1. When measuring flexural rigidity values (EI values) at the respective positions of the shaft 1 and then assuming that a sum of flexural rigidities at positions 150 mm, 200 mm and 250 mm from a shaft front end is A1, a sum of flexural rigidities at positions 400 mm, 450 mm and 500 mm from the shaft front end is A2 and a sum of flexural rigidities at positions 650 mm, 700 mm and 750 mm from the shaft front end is A3, the distribution of flexural rigidities was set so that a relationship of $1.70 \leq A3/A2$ and $0.60 \leq A1/A3$ was attained. Preferably, such distribution of flexural rigidities is $1.70 \leq A3/A2 \leq 2.00$ and $0.60 \leq A1/A3 \leq 0.70$. The reason is that the swing is stabilized further and an increase of the head speed of a golf club is stably increased, thereby also stabilizing the flight distance of a golf ball.

Figure 2:
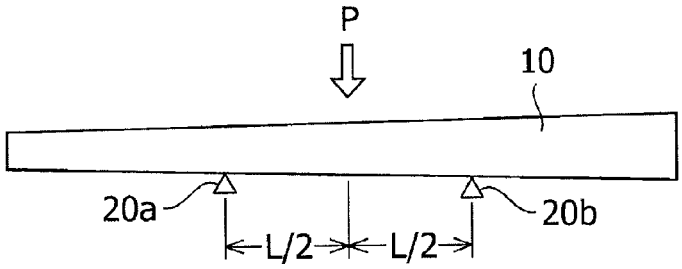
FIG. 2 is a schematic view for explaining a method of measuring an EI value of a shaft.

The EI value serves as an index for the flexural rigidity at a position a predetermined distance off the front end of the shaft 1, which is a product of a Young's modulus E and a second moment of area I. The EI value can be calculated from a following equation by carrying out a three-point bending test. The three-point bending test will be described with reference to FIG. 2. First, a shaft 10 is held horizontally with a pair of supports 20*a*, 20*b* spaced at a predetermined distance L. Then, a load P is applied to the shaft 10 perpendicularly thereto at a measuring point EI, which is a central position between the pair of the supports 20*a*, 20*b*. An amount of deformation a of the shaft 10 at this measuring point was measured to obtain the EI (kgf·mm$^2$) value. Usually, a distance L between the supports 20*a* and 20*b* is assumed to be 300 mm and a load P is assumed to be 20 kgf.

$$EI=(L^3/48)\cdot(P/\sigma)$$

L: distance between a pair of supports (mm)
P: load applied to the shaft (kgf)
a: amount of deformation of the shaft when load is applied (mm)

Regarding the flexural rigidity of a region 150 mm to 900 mm long from the front end of the shaft, preferably, the minimum value of the flexural rigidity is not more than $1.5\times10^6$ kgf/mm$^2$ and a difference between the maximum value and minimum value of the flexural rigidity is not less than $3.5\times10^6$ kgf/mm$^2$. As a result, while the shaft is allowed to bow easily, the rigidity of the hand grip portion is secured due to the flexural rigidity of the shaft, so that an improvement of the head speed using the flexure of the shaft and stability of a shaft behavior can be achieved at the same time.

From these viewpoints, more preferably, the minimum value of the flexural rigidity is 1.2 to 1.5 kgf/mm$^2$ and a difference between the maximum value and the minimum value of the flexural rigidity is 3.7 to 4.5 kgf/mm$^2$.

The shaft 1 is made of fiber-reinforced resin and preferably, the shaft 1 is formed of a laminated body of fiber-reinforced prepreg. Such a shaft 1 can be reinforced in part easily, so that its rigidity can be adjusted easily and the mass of the shaft can be decreased. The rigidity of the shaft 1 may be adjusted by changing the length, shape and position of the prepreg and coefficient of elasticity of reinforced fiber.

Preferably, the lower limit of the mass of the shaft is about 35 g, more preferably about 38 g. The reason is that if the shaft is too light, ordinary carbon-fiber reinforced fiber resin used for formation of the shaft increases the torque of the shaft and consequently, when a golf ball is hit off the sweat area of a golf club head, a feeling of hitting the ball becomes very inferior.

Furthermore, preferably, the upper limit of the mass of the shaft is about 45 g, more preferably 44 g. The reason is that the head can be kept heavy by controlling the mass of the shaft not to be excessive, so that even if the length of the shaft is increased, a swing balance which allows the golf club to be swung through a stabilized swing path can be secured.

Figure 3:
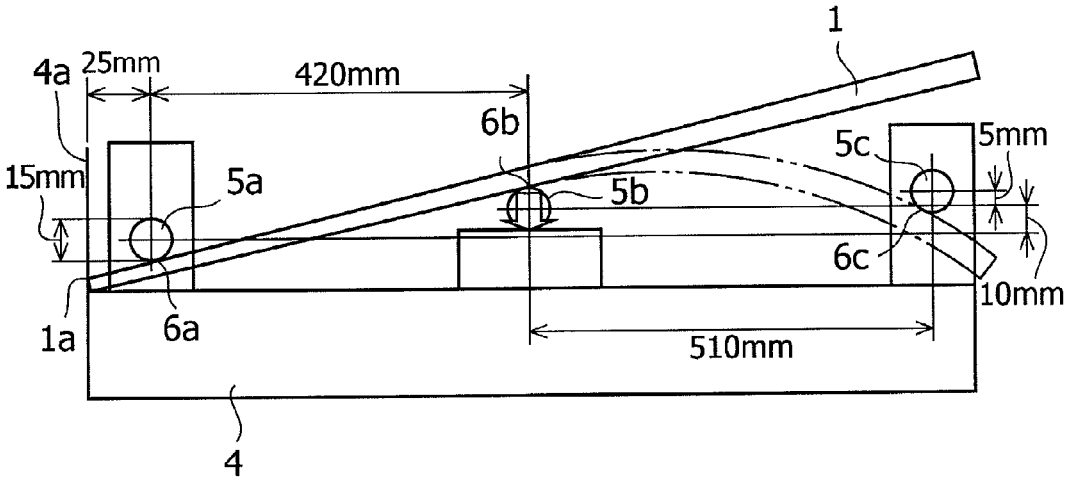
FIG. 3 is a diagram showing a measuring method of load value according to 3-point support measuring method using a platform scale flexing measuring apparatus.

FIG. 3 shows a measuring method of load values based on the three-point support measuring method using a platform flexing measuring apparatus. The "flexing" indicates hardness (softness) of a club and is expressed with R, S, and XS. For the flexing, no hardness standard has been determined and no measuring method has been determined, but there are multiple methods available, such as cantilever type measuring method (forward type, inverted type), frequency measuring method, three-point support measuring method and the like. In the present invention, a load value is measured according to the three-point support measuring method using the platform flexing measuring apparatus and this value is regarded as a criterion. According to the three-point support measuring method, the shaft is fixed at its both ends and set so that the central portion has a specified bending distance. With a scale provided at the central portion, a force by which the shaft attempts to be restored to its original straight form is measured as the load value.

In the platform flexing measuring apparatus shown in FIG. 3, the shaft 1 is supported by supporting members 5*a* to 5*c* located at three positions 25 mm, 445 mm and 955 mm away from an end portion 4*a* of the platform. In the meantime, the diameter of each supporting member is 15 mm and respective supporting members are set so that the supporting member 5*b* is 10 mm higher than 5*a* and the supporting member 5*c* is 5 mm higher than 5*b*. In the shaft 1 to be measured, first, a front end 1*a* of the shaft 1 is kept in a contact with an end portion 4*a* of a platform 4, a front end side upper portion 6*a* of the shaft 1 is supported with the supporting member 5*a* and then, a central lower portion 6*b* is supported with the supporting member 5*b*. Afterwards, the shaft 1 is bowed and a rear end side upper portion 6*c* is supported with the supporting member 5*c*. When the shaft 1 is bowed in this state, a load is generated from the shaft 1 toward a load cell 7. A load value is measured with a load measuring means (not shown) provided on the load cell 7 and used as a criterion of the flexing.

The measured flexing is preferred to be a load value of not more than 4.3 kg. This is because when the load value exceeds 4.3 kg, it may be difficult to adequately provide flexure of the shaft and sufficient increase of the head speed, so that the flight distance of a golf ball is not fully increased. In contrast, if the load value is too small, the shaft is bowed too much, and thereby, it is difficult to hit the golf ball. Considering a balance between an impact applied to a golf ball and the flight distance of the golf ball, the flexing is preferred to be about 4.2 kg as the upper limit of the load value and more preferably to be about 4.0 kg. Then, the lower limit of the load value is preferred to be about 3.5 kg and more preferably to be about 3.7 kg.

The feature of the golf club of the present invention exists in having the golf club shaft and preferably, an entire length of the golf club is about 43 inches to about 48 inches (about 1092.2 mm to about 1219.2 mm). The total weight of the golf club is preferred to be about 260 g to about 300 g.

EXAMPLES

Figure 4:
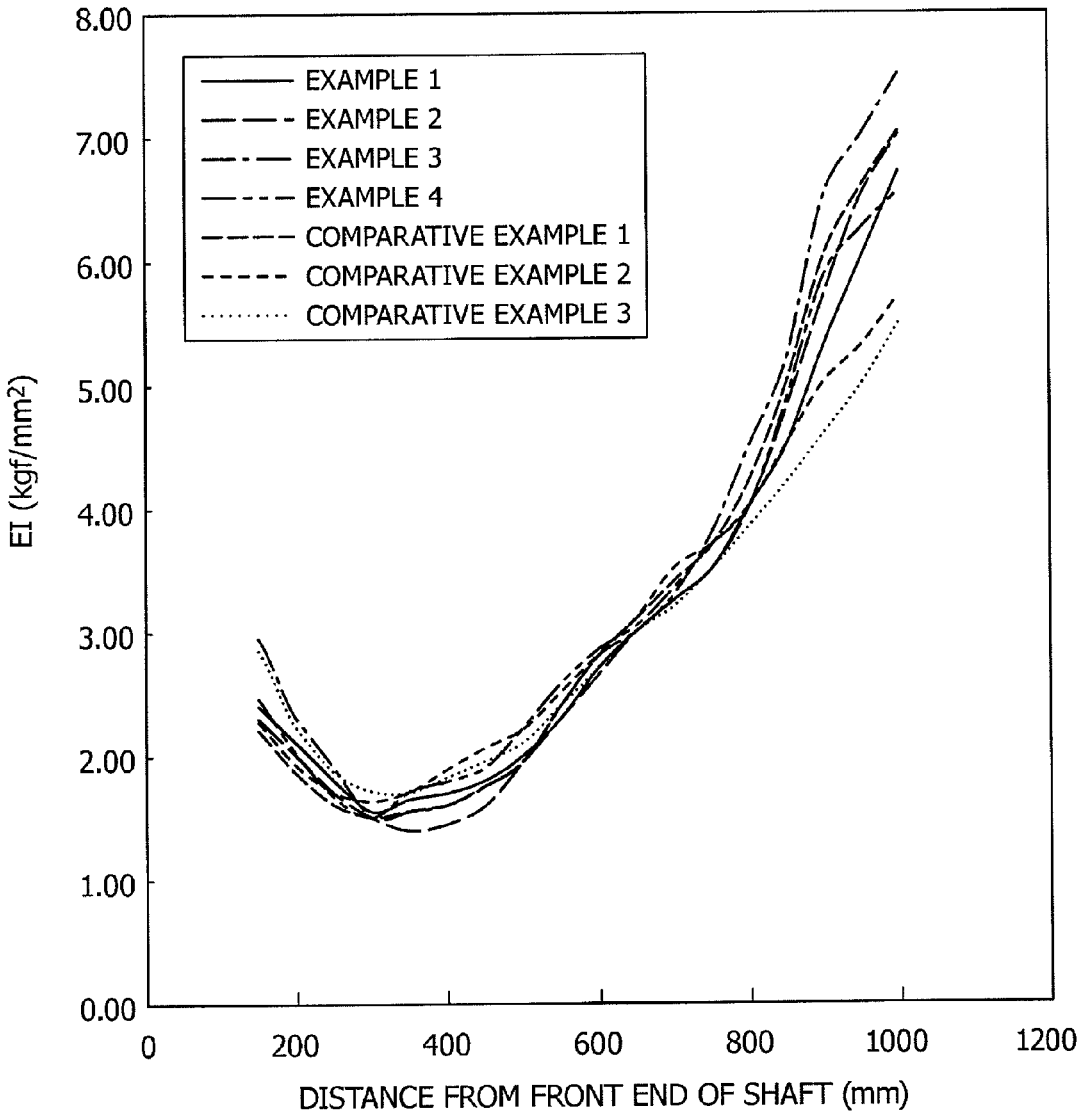
FIG. 4 is a graph showing rigidity values measured on each shaft of Examples 1 to 4 and Comparative Examples 1 to 3.

Seven types of shafts 1120 mm long (Examples 1 to 4, Comparative Examples 1 to 3) were produced and the EI value was measured at positions every 50 mm from the front end of a shaft. Table 1 and FIG. 4 show measuring results. In Table 1, the unit of the EI value (kgf/mm$^2$) is omitted.

TABLE 1

| Distance from front end of shaft (mm) | Example 1 | Example 2 | Example 3 | Example 4 | Comparative example 1 | Comparative example 2 | Comparative example 3 |
|---|---|---|---|---|---|---|---|
| 150 | 2.40 | 2.30 | 2.75 | 2.45 | 2.20 | 2.26 | 2.65 |
| 200 | 2.10 | 2.00 | 2.30 | 2.00 | 1.85 | 1.91 | 2.22 |
| 250 | 1.80 | 1.70 | 1.90 | 1.65 | 1.60 | 1.69 | 1.86 |
| 300 | 1.55 | 1.50 | 1.50 | 1.62 | 1.50 | 1.62 | 1.71 |
| 350 | 1.65 | 1.40 | 1.55 | 1.70 | 1.55 | 1.70 | 1.70 |
| 400 | 1.70 | 1.45 | 1.60 | 1.78 | 1.60 | 1.88 | 1.82 |
| 450 | 1.80 | 1.60 | 1.75 | 1.89 | 1.75 | 2.05 | 1.95 |
| 500 | 2.00 | 1.95 | 1.95 | 2.21 | 1.95 | 2.20 | 2.10 |
| 550 | 2.30 | 2.30 | 2.40 | 2.57 | 2.40 | 2.50 | 2.40 |
| 600 | 2.70 | 2.65 | 2.80 | 2.84 | 2.80 | 2.80 | 2.70 |
| 650 | 3.00 | 3.00 | 3.00 | 3.03 | 3.10 | 3.10 | 3.00 |
| 700 | 3.25 | 3.25 | 3.30 | 3.34 | 3.40 | 3.50 | 3.20 |
| 750 | 3.50 | 3.50 | 3.80 | 3.69 | 3.69 | 3.69 | 3.50 |
| 800 | 4.00 | 4.00 | 4.50 | 4.00 | 4.21 | 4.00 | 3.85 |
| 850 | 4.50 | 4.80 | 5.20 | 4.86 | 5.00 | 4.50 | 4.20 |
| 900 | 5.30 | 5.70 | 6.50 | 5.85 | 6.02 | 5.00 | 4.60 |
| 950 | 6.00 | 6.50 | 7.00 | 6.24 | 6.58 | 5.30 | 5.00 |
| 1000 | 6.70 | 7.00 | 7.50 | 6.54 | 7.03 | 5.70 | 5.50 |

Based on the measuring result of the EI value, it is assumed that a sum of flexural rigidities at positions 150 mm, 200 mm and 250 mm from the front end of the shaft is A1, a sum of the flexural rigidities at positions 400 mm, 450 mm and 500 mm from the front end of the shaft is A2 and a sum of the flexural rigidities at positions 650 mm, 700 mm and 750 mm from the front end of the shaft is A3. Then, distributions of the flexural rigidities A3/A2 and A1/A3 were calculated. Furthermore, using a platform flexing measuring apparatus shown in FIG. 3, the load value of a shaft was measured according to the three-point support measuring method, and the measured value was used as a criterion of the flexing.

Table 2 shows a distribution of the flexural rigidity and the flexing, the minimum value of the flexural rigidity obtained from the measuring result of the EI value, a difference between the maximum value and minimum value of the flexural rigidity (difference in rigidity) and mass of the shaft.

TABLE 2

| | Distribution of flexural rigidity | | Minimum value of flexural rigidity | Difference in flexural rigidity | Flexing (load value) | Mass | Diameter of front end |
|---|---|---|---|---|---|---|---|
| | A3/A2 | A1/A3 | (kgf/mm$^2$) | (kgf/mm$^2$) | (kg) | (g) | (mm) |
| Example 1 | 1.77 | 0.65 | 1.55 | 3.75 | 4.2 | 47.5 | 8.5 |
| Example 2 | 1.95 | 0.62 | 1.40 | 4.30 | 4.0 | 42.1 | 9.5 |
| Example 3 | 1.91 | 0.69 | 1.50 | 5.00 | 4.1 | 43.6 | 9.0 |
| Example 4 | 1.72 | 0.61 | 1.49 | 4.36 | 4.3 | 44.8 | 9.0 |
| Comparative example 1 | 1.92 | 0.55 | 1.50 | 4.52 | 4.1 | 44.8 | 8.5 |
| Comparative example 2 | 1.68 | 0.57 | 1.62 | 3.38 | 4.8 | 50.2 | 8.5 |
| Comparative example 3 | 1.65 | 0.69 | 1.70 | 2.90 | 4.5 | 48.2 | 9.0 |

Figure 5:
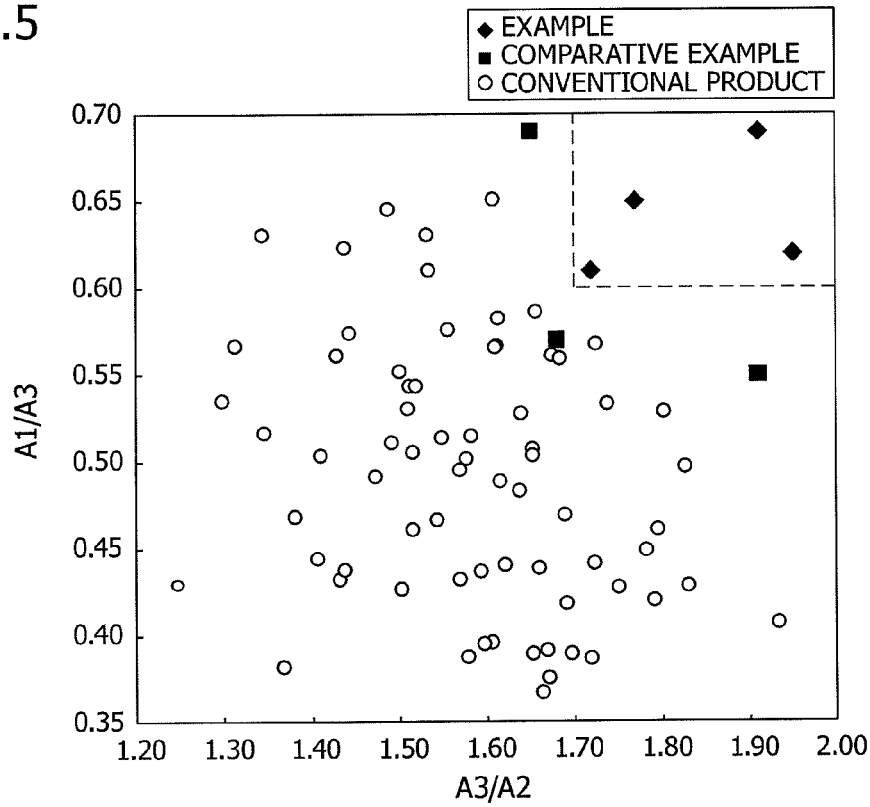
FIG. 5 is a distribution diagram showing a distribution of flexural rigidity of each shaft of Examples 1 to 4 and Comparative Examples 1 to 3.

FIG. 5 is a distribution diagram showing a distribution of flexural rigidities of each shaft according to Examples 1 to 4 and Comparative Examples 1 to 3. This diagram also shows data of conventionally marketed shafts. According to this diagram, each shaft of Examples 1 to 4 is found in a range that its A3/A2 is 1.70 or more and its A1/A3 is 0.60 or more.

Figure 6:
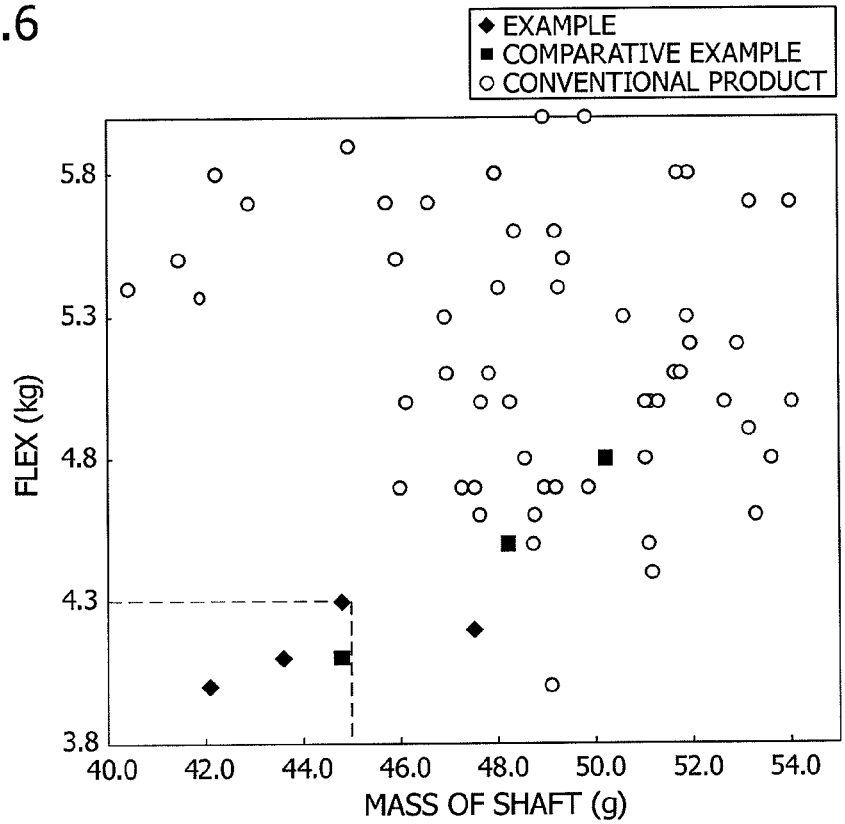
FIG. 6 is a distribution diagram showing mass and platform scale flexing of each shaft of Examples 1 to 4 and Comparative Examples 1 to 3.

FIG. 6 is a distribution diagram showing the mass and platform flexing of each shaft according to Examples 1 to 4 and Comparative Examples 1 to 3. FIG. 6 shows data of the conventionally marketed shafts, like FIG. 5.

A head having a volume of 460 cc, a mass of 191 g and an insertion amount (depth of a hosel hole in which the front end of a shaft is to be inserted) of 32 mm and a grip having a length of 270 mm, a mass of 47 g and a grip diameter of 62 were attached to each shaft of Examples 1 to 4 and Comparative Examples 1 to 3 so as to construct a golf club having a length of 45.5 inches (equivalent to 1155.7 mm) and having swing weight D2. The shaft length of the constructed golf club was about 1120 mm.

In an experiment, an average golfer actually tried each golf club produced in the above-described manner to hit golf balls. Table 3 shows results of the evaluations of that test hitting.

TABLE 3

| | Flight distance | Stability of swing | Ease of swing | Impression |
|---|---|---|---|---|
| Example 1 | 3 | 3 | 4 | The front end and grip portion are both hard and a high stability is secured. However, it is heavy and improvements in the head speed and flight distance are small. |
| Example 2 | 4 | 3 | 3 | The grip portion is hard and a firm gripping is secured. The rigidity of the front end is appropriate and the weight is low, so that improvement in flight distance is remarkable. |
| Example 3 | 3 | 4 | 3 | The front end and grip portion are both relatively hard and a high stability and a firm gripping are secured. |
| Example 4 | 3 | 3 | 3 | Rigidities of individual portions are well balanced and each item has an advantage over conventional products. |
| Comparative example 1 | 3 | 2 | 3 | The flight distance is improved because the front end is soft and the weight is low. However, this lacks stability. |
| Comparative example 2 | 2 | 1 | 2 | The central portion is a hard shaft of conventional type, which lacks stability and flight distance performance. |
| Comparative example 3 | 2 | 3 | 2 | Although the front end is hard and stability is secured, little improvement in flight distance is found. The grip portion is soft, ease of swing is low. |

Flight distance 4: Very good flight, 3: good flight, 2: not so good flight, 1: bad flight
Stability of swing 4: stabilized much, 3: stabilized, 2: stabilized not so much, 1: not stabilized
Easiness of swing 4: Very easy to swing, 3: easy to swing, 2: not so easy to swing, 1: not easy to swing Table 3 shows that each golf club using the shafts according to Examples 1 to 4 exhibited an excellent result in the flight distance, stability of swing and ease of swing, thereby demonstrating that they were well balanced golf clubs.

Speaking more in detail, because in a region in which A3/A2 is 1.70 or more and A1/A3 is 0.60 or more in FIG. 5, the central portion of the shaft is relatively soft, flexure of the shaft is intensified so that the head speed is increased. Furthermore, a grip feeling of the shaft is relatively hard and consequently, golfers have a secure grip feeling at a switch point from his or her backswing motion to their downswing motion and at a time of his or her uncock motion, so that his swing is stabilized. Still further, hardness of the front end portion of the shaft is secured and consequently, a behavior of the shaft just before an impact occurs becomes likely to be constant. That is, because the results of Examples 1 to 4 are included in the region in FIG. 5, Examples 1 to 4 satisfied the above-described performance relating to the head speed, stability of swing and a constant behavior of the shaft.

On the other hand, the golf clubs using the shafts according to Comparative Examples 1 to 3 provided inferior results in any performance relating to the flight distance, stability of swing, and ease of swing, thereby indicating that they were badly balanced golf clubs. That is, because the results of Comparative Examples 1 to 3 are not included in the above-described region in FIG. 5, Comparative Examples 1 to 4 were inferior to Examples in such performance as the head speed and behavior of the shaft.

A phenomenon in which the head speed was inclined to rise was noticed in the region in which the mass of the shaft was less than 45 g and the flexing was less than 4.3 kg in FIG. 6. Examples 2 and 3, the results of which were included in this region, provided excellent results in relationship between the mass of shaft and flexing, and particularly an excellent result in that the head speed was improved due to ease in bowing of the shaft and light weight of the shaft, thereby increasing the maximum flight distance.

No shafts of Example 1 were included in the region and their head speed was relatively inferior because the shafts were slightly heavy. However, balance of performances such as flight distance, stability of swing and ease of swing were excellent, indicating that they were totally superior shafts.

Although shafts of Comparative Example 1 were included in that region and the shafts were light and the head speed was excellent, hardness of the shaft front end was insufficient, and therefore, the stability of the swing was inferior.

What is claimed is:

1. A golf club shaft having a length of 1050 mm to 1170 mm and having a distribution of flexural rigidities of $1.70 \leq A3/A2$ and $0.60 \leq A1/A3$;

wherein a sum of flexural rigidities at positions 150 mm, 200 mm and 250 mm from the front end of the shaft is A1, wherein a sum of flexural rigidities at positions 400 mm, 450 mm and 500 mm from the front end of the shaft is A2, wherein a sum of flexural rigidities at positions 650 mm, 700 mm and 750 mm from the front end of the shaft is A3, and wherein the mass of the shaft is not more than 45 g and flexing thereof is not more than 4.3 kg in terms of a load value based on a three-point support measuring method.

2. The golf club shaft according to claim 1, wherein the distribution of the flexural rigidities is $1.70 \leq A3/A22.00$ and $0.60 \leq A1/A30.70$.

3. The golf club shaft according to claim 1, wherein regarding the flexural rigidity of a section 150 mm to 900 mm long from the front end of the shaft, the minimum value of the flexural rigidity is not more than $1.5 \times 10^6$ kgf/mm$^2$ and the difference between the maximum value and minimum value of the flexural rigidity is not less than $3.5 \times 10^6$ kgf/mm$^2$.

4. A golf club comprising a golf club shaft according to claim 1.

* * * * *